US011613860B2

(12) United States Patent
Firth

(10) Patent No.: US 11,613,860 B2
(45) Date of Patent: Mar. 28, 2023

(54) SALT, SAND, AND ICE MELT SPREADER SYSTEM

(71) Applicant: Enduraplas, LLC, Neche, ND (US)

(72) Inventor: Gregory Firth, Neche, ND (US)

(73) Assignee: Enduraplas, LLC, Neche, ND (US)

( * ) Notice: Subject to any disclaimer, the term of this patent is extended or adjusted under 35 U.S.C. 154(b) by 97 days.

(21) Appl. No.: 17/076,026

(22) Filed: Oct. 21, 2020

(65) Prior Publication Data

US 2021/0123200 A1 Apr. 29, 2021

Related U.S. Application Data

(60) Provisional application No. 62/925,141, filed on Oct. 23, 2019.

(51) Int. Cl.
*E01H 10/00* (2006.01)
*E01C 19/20* (2006.01)

(52) U.S. Cl.
CPC ..... *E01H 10/007* (2013.01); *E01C 19/205* (2013.01); *E01C 2019/208* (2013.01)

(58) Field of Classification Search
CPC ..... E01H 10/007; E01C 19/20; E01C 19/201; E01C 19/203; E01C 19/205; E01C 2019/2055; E01C 2019/207; E01C 2019/2075; E01C 2019/208
See application file for complete search history.

(56) References Cited

U.S. PATENT DOCUMENTS

| | | | | |
|---|---|---|---|---|
| 4,253,612 | A * | 3/1981 | Schulze | A01C 17/00 239/672 |
| 6,220,532 | B1 * | 4/2001 | Manon | E01C 19/203 239/681 |
| 9,296,571 | B2 * | 3/2016 | Truan | B65G 65/46 |
| 9,931,971 | B1 * | 4/2018 | Null | A01C 15/18 |
| 2005/0184174 | A1 * | 8/2005 | Bailey | E01C 19/203 239/668 |
| 2007/0069044 | A1 * | 3/2007 | Sandler | E01C 19/204 239/146 |
| 2011/0186649 | A1 * | 8/2011 | Richardson | B05B 9/03 239/146 |
| 2013/0233937 | A1 * | 9/2013 | Norkus | E01H 10/007 239/10 |
| 2017/0107680 | A1 * | 4/2017 | Gamble, II | B65G 31/04 |

* cited by examiner

*Primary Examiner* — Darren W Gorman
(74) *Attorney, Agent, or Firm* — William H. Honaker; Dickinson Wright PLLC

(57) ABSTRACT

A system for spreading material on a surface comprises a housing having a closed bottom and an open top to allow the material to be loaded into the housing and to store the material. A pair of interior walls are spaced from one another and extend between a first end of the housing and a second end of the housing. A dispenser is selectively coupled to the housing via an interlocking connection between the housing and the dispenser to allow the dispenser to be removed from the housing to define a disassembled position and to be attached to the housing to define an assembled position. The interlocking connection is formed by a sliding connection between the housing and the dispenser adjacent the first end.

8 Claims, 8 Drawing Sheets

SALT, SAND, AND ICE MELT SPREADER SYSTEM

CROSS-REFERENCE TO RELATED APPLICATIONS

This application claims the benefit of U.S. Provisional Application Patent Ser. No. 62/925,141, filed on Oct. 23, 2019, the entire disclosure of which is hereby incorporated herein by reference in its entirety.

BACKGROUND OF THE INVENTION

1. Field of the Invention

The present invention generally relates to salt spreaders and more particularly to a salt, sand, and ice melt spreader system.

2. Description of the Prior Art

Salt spreaders are generally well known in the art to apply salt, sand, or ice melting compound to a walking surface, road surface, or parking lot surface for providing traction to the surface or melting ice on the surface. Conventional salt spreaders may be mounted the back of a vehicle and dispense the material as the vehicle moves. Typically, these spreaders include a housing for storing the material and a dispenser at the bottom of the housing for controlling the rate at which the material is dropped from the housing. These dispensers are often integral to the housing or difficult to access or remove.

Another issue of conventional spreaders is the way the salt is delivered as it exits the spreader. Due to its design, the delivery device typically does not spread the material evenly on the surface and often allows the material to deflect in unintended directions. The delivery device is generally horizontal, which makes the material rest on or deflect upwardly from the delivery device as it exits the housing. Additionally, the material is only applied to a portion of the surface due to the location of the delivery device.

SUMMARY OF THE INVENTION

The present invention provides a spreader system that provides greater control over the distribution of a material, such as salt, sand, or ice melting material to a surface. The present invention also provides a spreader system that is easy to assemble. Further, the present invention provides for efficient distribution of the material on the surface. In addition, the present invention provides at least one foot of the spreader system for even application of the material to the surface.

It is one aspect of the present invention to provide a system for spreading material on a surface. The system comprises a housing having a closed bottom and an open top to allow the material to be loaded into the housing and to store the material. A pair of interior walls are spaced from one another and extend between a first end of the housing and a second end of the housing. A dispenser is selectively coupled to the housing via an interlocking connection between the housing and the dispenser to allow the dispenser to be removed from the housing to define a disassembled position and to be attached to the housing to define an assembled position. The interlocking connection is formed by a sliding connection between the housing and the dispenser adjacent the first end.

It is another aspect of the present invention to provide at least one foot of a salt, sand, or ice melting compound spreader system. The at least one foot comprises an upright portion for connection to a tubing of the spreader system. A tray portion extends outwardly at an oblique angle relative to the upright portion to a peripheral edge for allowing the salt, sand, or ice melting compound to deflect laterally from a terminal end of the tubing. A finger is between the tubing and the tray portion. The finger extends at an oblique angle from the upright portion toward the peripheral edge. The finger includes a plurality of opposing surfaces connected to one another and extending toward the tray portion.

It is another aspect of the present invention to provide a system for spreading material on a surface. The system comprises a housing having a closed bottom and an open top to allow the material to be loaded into the housing and to store the material. A pair of interior walls are spaced from one another and extend between a first end of the housing and a second end of the housing. A dispenser is selectively coupled to the housing via an interlocking connection between the housing and the dispenser to allow the dispenser to be removed from the housing to define a disassembled position and to be attached to the housing to define an assembled position. An auger extends between the dispenser and the housing for moving the material between the housing and the dispenser.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE ENABLING EMBODIMENT

Figure 1:
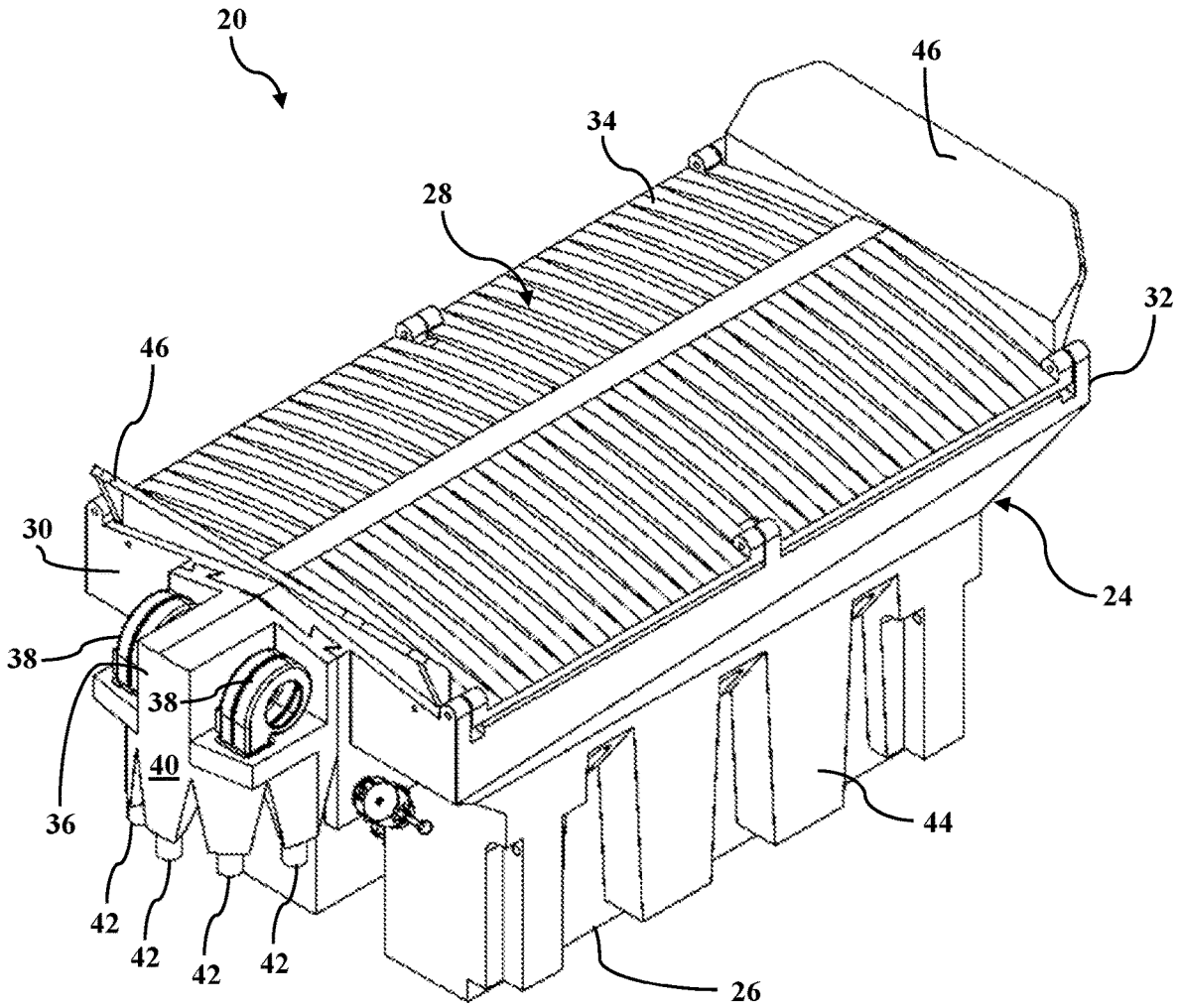
FIG. 1 is a perspective view of the spreader system of the present invention in an assembled position.
Figure 2:
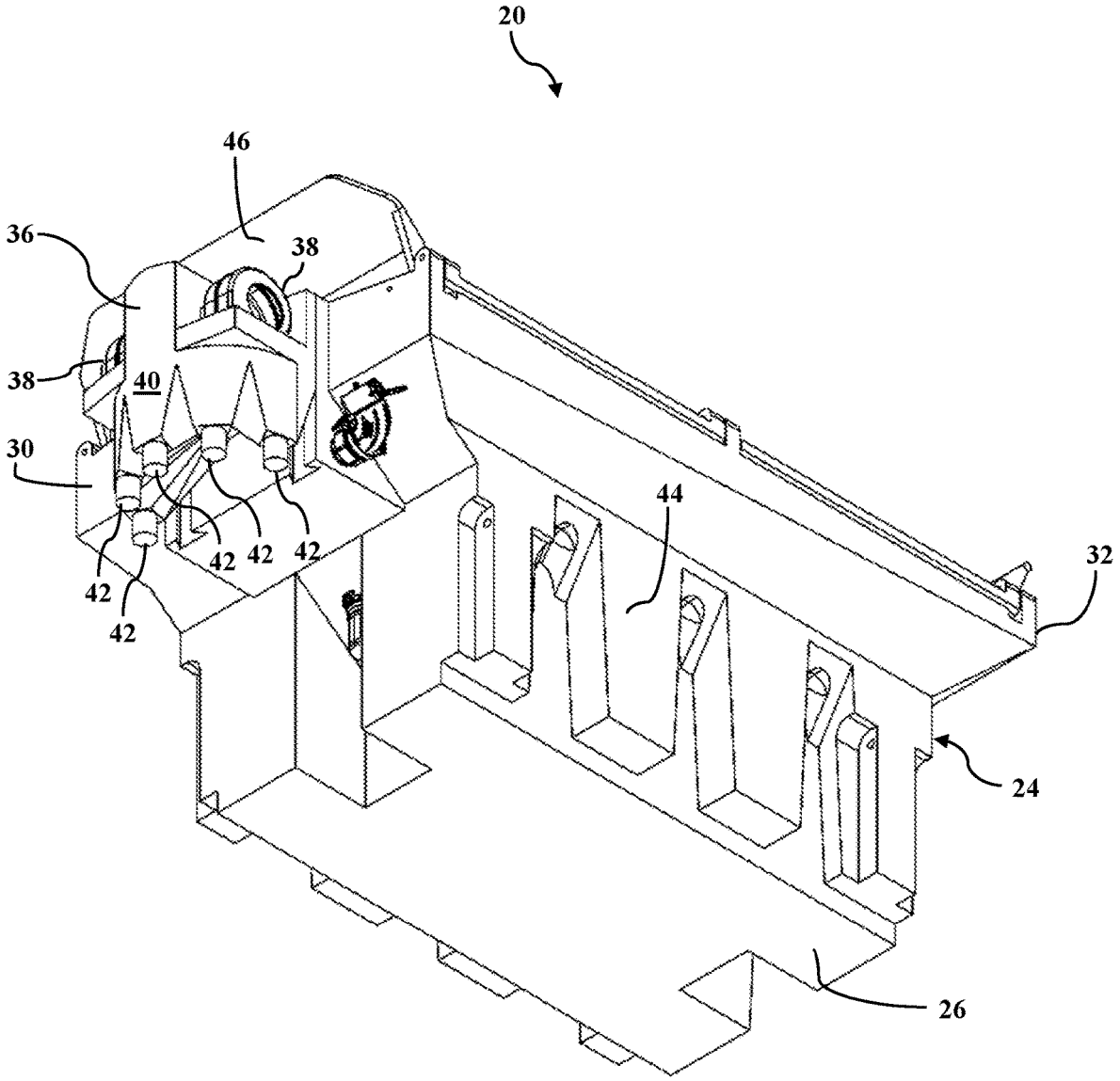
FIG. 2 is a perspective view of the spreader system of the present invention in the assembled position.
Figure 3:
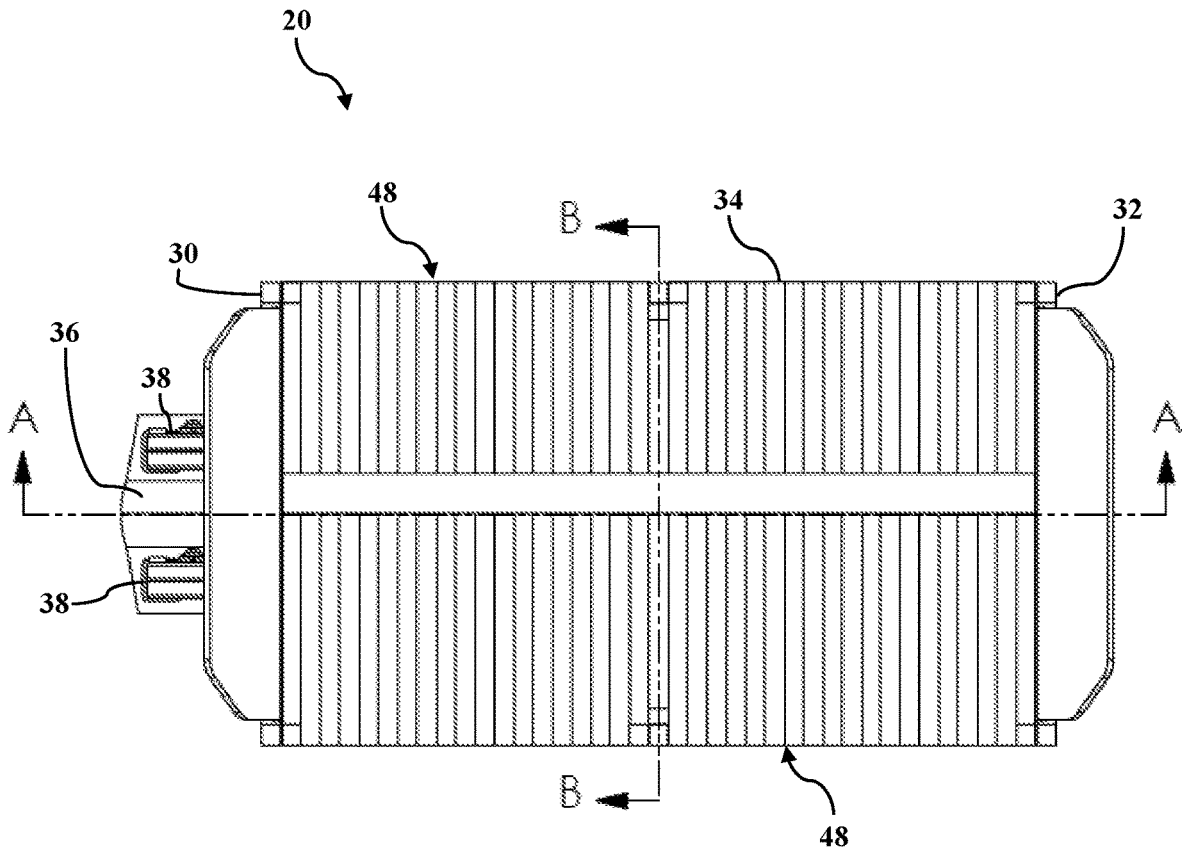
FIG. 3 is a top view of the spreader system of the present invention.

Referring to the Figures, wherein like numerals indicate corresponding parts throughout the several views, a spreader system 20 for spreading material 22 on a surface constructed in accordance with one embodiment of the present invention is generally shown in FIGS. 1-3. It should be appreciated that the material 22 may be either salt, sand, or an ice-melting compound, and the surface may be a road surface, walking surface, or parking lot surface.

The spreader system 20 includes a housing 24, or hopper, having a closed bottom 26 and an open top 28 to allow the material 22 to be loaded into the housing 24 and to store the material 22. The housing 24 extends between a first end 30 and a second end 32 and includes a cover 34 that attaches to the open top 28 to selectively move between an open position and a closed position for covering the open top 28. A dispenser 36 is selectively coupled to the housing 24 via an interlocking connection between the housing 24 and the dispenser 36 to allow the dispenser 36 to be removed from the housing 24 to define a disassembled position and to be attached to the housing 24 to define an assembled position. At least one blower 38 is disposed on the dispenser 36 to apply pressurized air to the material 22. The dispenser 36 includes a manifold 40 having a plurality of outlets 42 for outputting the material 22. The manifold 40 is in fluid communication with the at least one blower 38 to provide pressurized dispensing of the material 22.

The housing 24 is supported by a mounting base 44. The mounting base 44 can be separate or unitary with the housing 24. The housing 24 can also include integrated liquid tanks for holding water for pre-wetting or to hold brine or other anti-icing and de-icing liquids. As disclosed, the housing 24 and base 44 are made of polyethylene or stainless steel with single or double wall construction. Sideboards 46 may be provided to assist loading. In other words, at least one sideboard 46 extends upwardly at an oblique angle from the top 28 of the housing 24 to guide the material 22 into the housing 24 as the material 22 is loaded into the housing 24.

Figure 4:
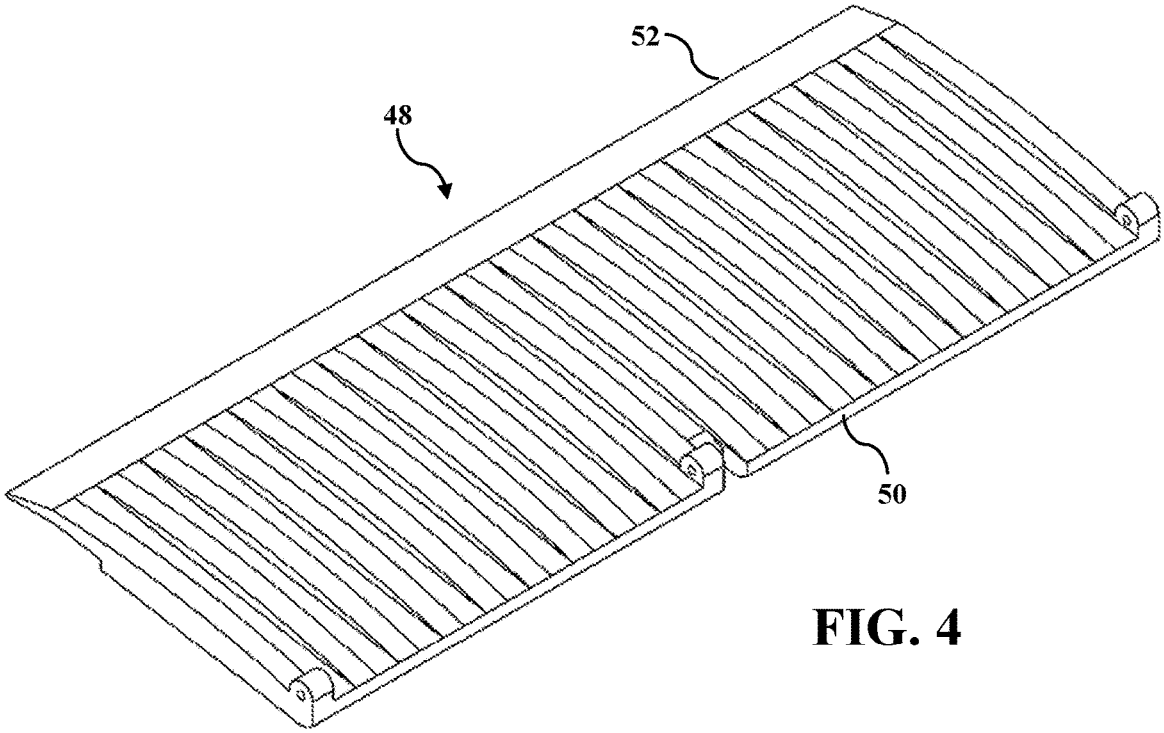
FIGS. 4 and 5 are perspective view of a cover of the spreader system of the present invention.
Figure 5:
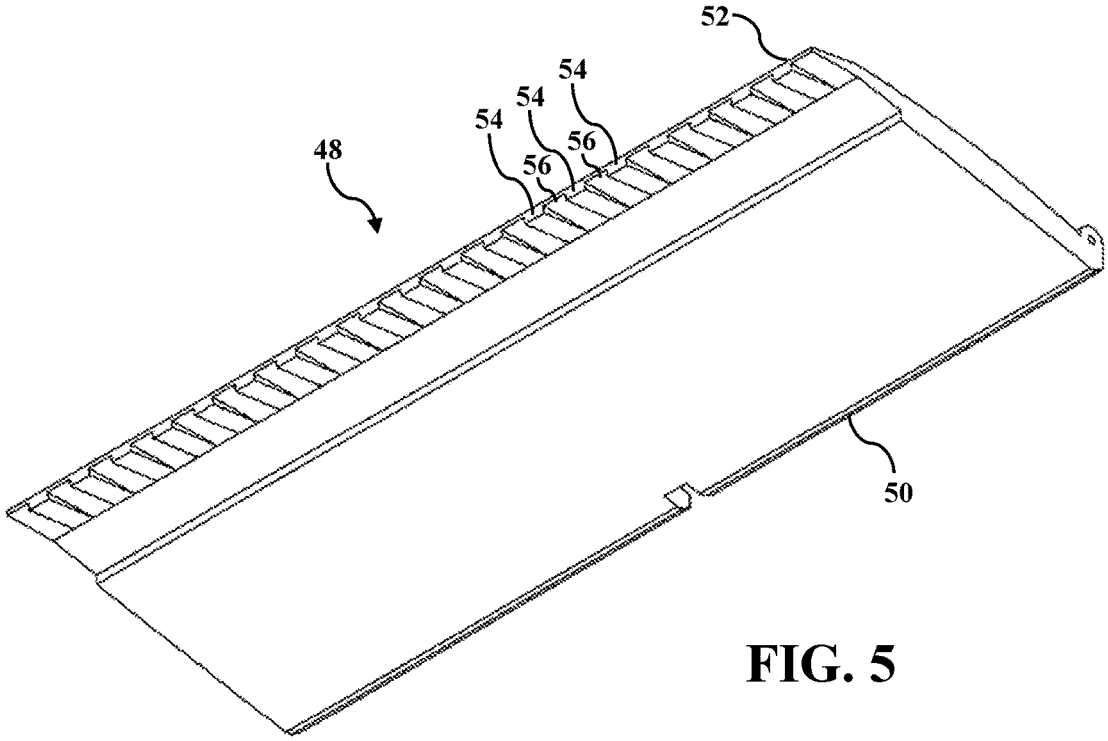

Referring now to FIGS. 4 and 5, the cover 34 may be a polyethylene V lid or polyethylene cross flow lid with optional electric open and closing mechanisms. Another alternative would be a tarp or other similar cover 34. The cover 34 includes two partitions 48 that each extends between a hinged end 50 to a free end 52. The two partitions 48 fold together in the closed position to cover 34 the open top 28. Each partition 48 includes protrusions 54 spaced from one another by notches 56 in an alternating fashion adjacent the free end 52. In particular, the alternating pattern of the free end 52 of each partition 48 may be offset from one another, such that the protrusions 54 of one partition and the notches 56 of the other partition 48 mesh together in the closed position.

Figure 6:
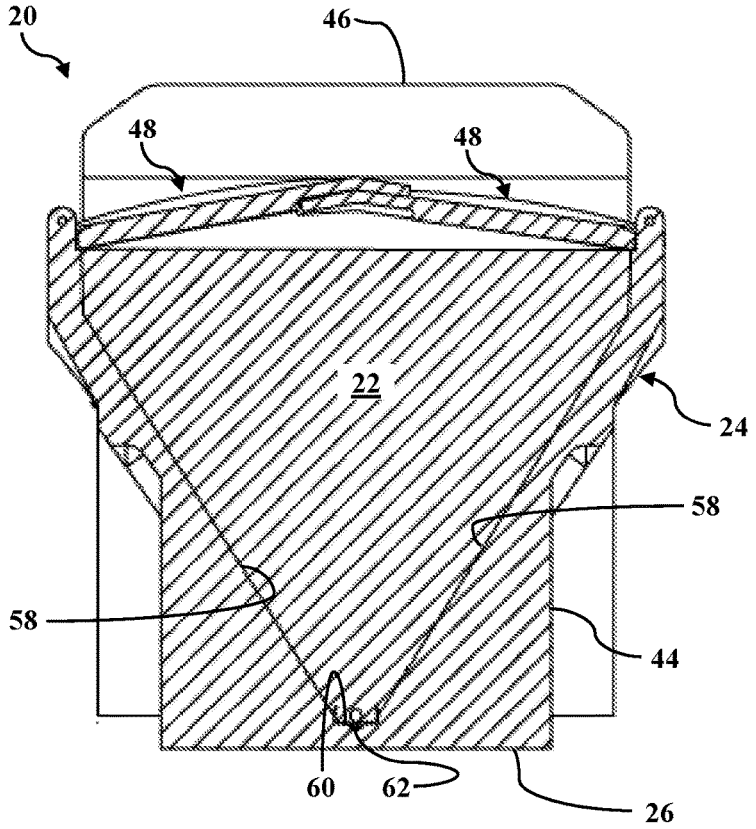
FIG. 6 is a cutaway view of the spreader system of the present invention taken at sectional line B-B in FIG. 3.
Figure 7:
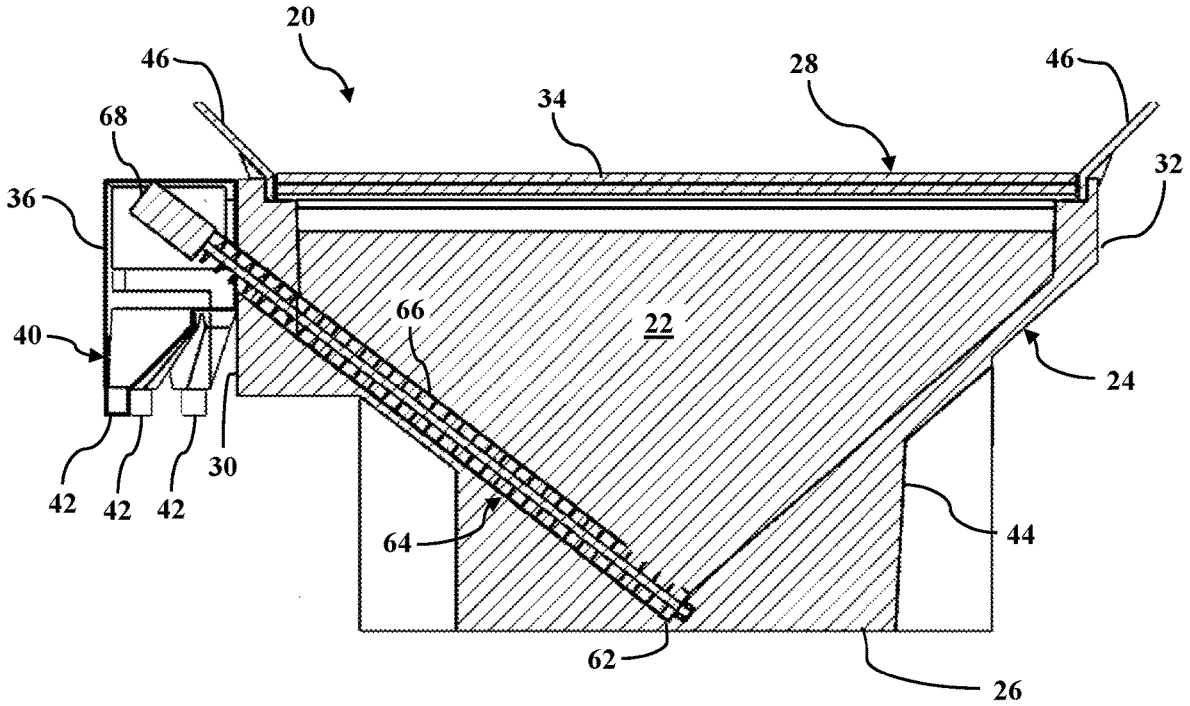
FIG. 7 is a cutaway view of the spreader system of the present invention taken at sectional line A-A in FIG. 3.

Referring now to FIGS. 6 and 7, the housing 24 includes a pair of interior walls 58 that are spaced from one another and extend between the first end 30 and the second end 32 for interacting with the material 22. A trough 60 is disposed adjacent the bottom 26 between the pair of interior walls 58. The interior walls 58 may generally form a pyramid shape with the vertex 62 of the pyramid at the base 44, or the trough 60, of the housing 24. An auger 64 extends between the dispenser 36 and the housing 24 for moving the material 22 between the housing 24 and the dispenser 36. The auger 64, which may be a single auger, may extend from the vertex 62 to an upper portion of the housing 24, and further into the manifold 40 to empty the material 22 into the dispenser 36. In some embodiments, the auger 64 is a polyethylene or stainless flight auger with a stainless tube 66. A vibrator may also be used and could fit to the tube 66 to facilitate even continual flow of the material 22. A motor 68 and a gearbox are disposed in the dispenser 36 for driving the auger 64. As illustrated, the motor 68 and the gearbox may be mounted at the topmost end of the auger 64. The motor 68 and gearbox may include speed controls and be reversible.

It should be appreciated by those of ordinary skill in the art that other housing 24 could have other than the pyramid shaped disclosed. The housing 24 could have a more flat bottom 26, instead of having a vertex 62, i.e. it could be a truncated pyramid shape. Such a shape may require an additional auger as well as a horizontal auger. Other shapes are clearly within the skill of those of ordinary skill in the art. Also, different auger arrangements will be known depending upon the shape of the housing 24.

The dispenser 36 includes distribution chambers 70 connected to the plurality of outlets 42, or dispensing tubes 42, for outputting the material 22. As illustrated, the chambers 70 are generally V-shaped to facilitate adequate flow to the plurality of outlets 42. The blowers 38 mounted to the dispenser 36 are preferably electric or hydraulic driven fans which assist the flow of salt from the dispenser 36 through the plurality of outlets 42. It should be appreciated that the dispenser 36 is illustrated as having five dispensing tubes 42, but any reasonable number of outlets 42 may alternatively be included in the dispenser 36. A mesh screen can be mounted in the dispenser 36 to restrict large lumps from entering the dispenser tubes 42.

The spreader system 20 may include a controller for controlling the speed, acceleration, and other various parameters of the motor 68 and the at least one blower 38. The controller may further include a global positioning system (GPS), whereby the motor 68 and the at least one blower 38 are controlled base **44*d* on the GPS. In other words, the amount of material 22 distributed can be controlled base 44*d* on the actual location, speed, and acceleration of the spreader system 20, for example, by increasing and decreasing material 22 supplied to the dispenser 36. The controller may be disposed in the cab of a vehicle that the spreader system 20** is disposed on.

Figure 8:
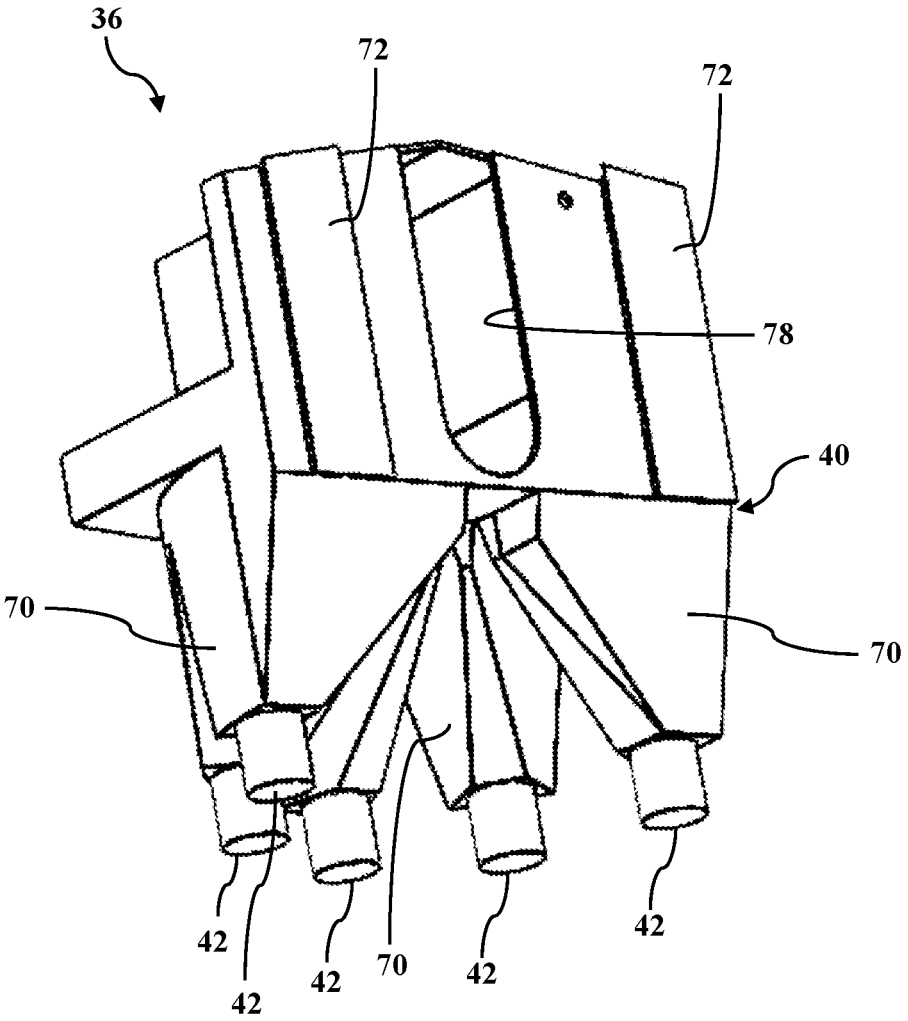
FIG. 8 is a perspective view of a dispenser of the spreader system of the present invention.
Figure 9:
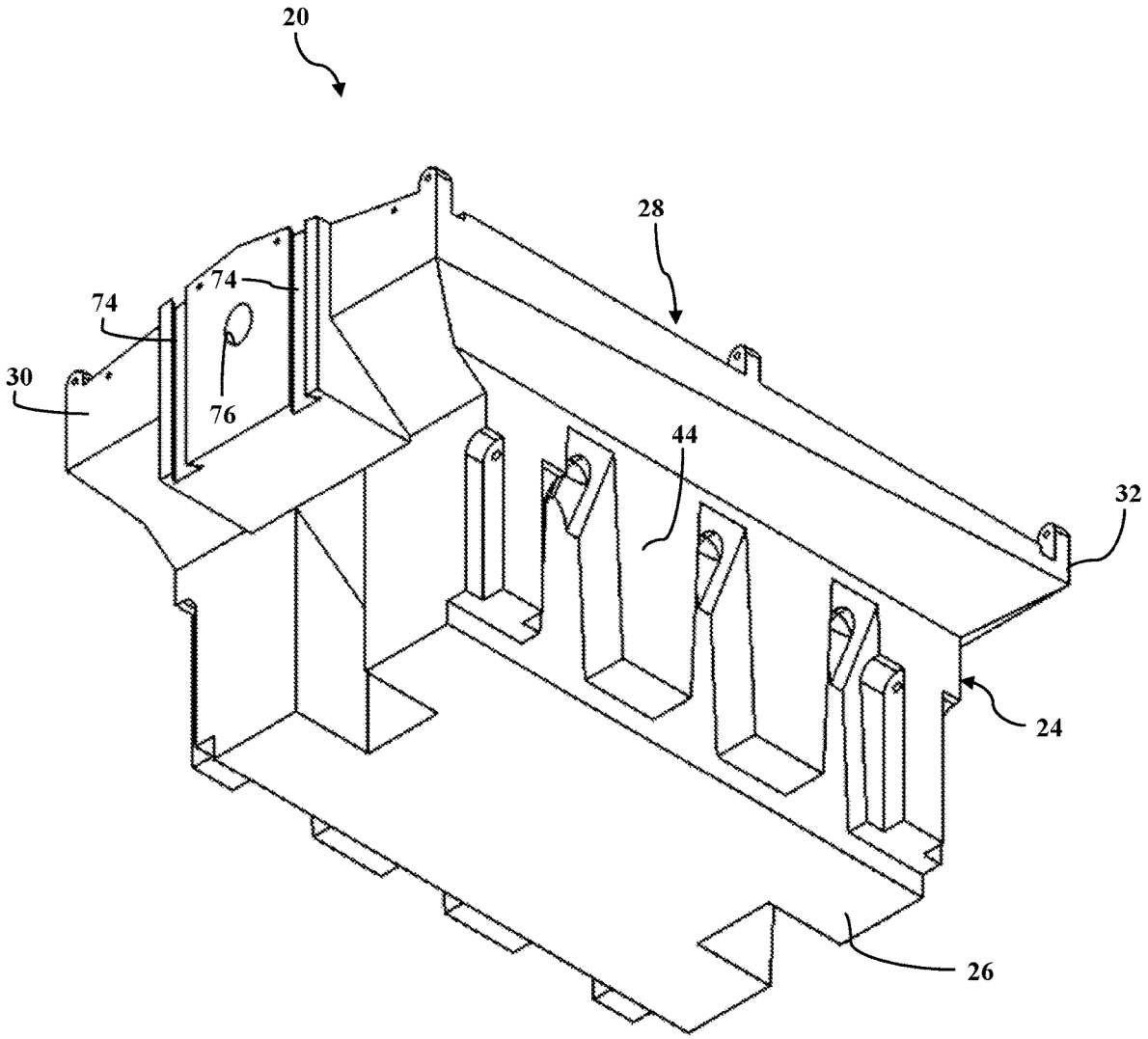
FIG. 9 is a perspective view of the spreader system of the present invention in a disassembled position.

Referring to FIGS. 8 and 9, the interlocking connection is formed by a sliding connection between the housing 24 and the dispenser 36 adjacent the first end 30 of the housing 24. The sliding connection includes at least one locking track 72 and defines at least one locking groove 74. In particular, locking grooves 74 mate with locking tracks 72 allowing the dispenser 36 to slide onto and off of the housing 24. The interlocking connection allows for easy assembly and disassembly as well as quick change of dispensers 36, if desired. In some embodiments, the at least one locking track 72 and the at least one locking groove 74 are each tapered on their edges, forming a trapezoidal cross-section. The tapered edges may allow the dispenser 36 to require upward or downward sliding in the at least one groove 74 in order to lock to the housing 24. The housing 24 defines a hole 76 disposed between the locking from for receiving a portion of the auger 64. A receptacle 78 is formed in the dispenser 36 for receiving another portion of the auger 64 to allow the auger 64 to extend between the housing 24 and dispenser 36 in the assembled position. In other words, in the assembled position, the hole 76 and the receptacle 78 are aligned with one another in the assembled position.

It should be appreciated that, in some embodiments, the at least one locking track 72 and the at least one locking groove 74 define the sliding connection. In some embodiments, the at least one locking track 72 extends outwardly from the dispenser 36 and the locking groove 74 is disposed on the housing 24. In some embodiments, locations of the at least one locking track 72 and the at least one locking groove 74 may be transposed between the housing 24 and the dispenser 36.

Figure 10:
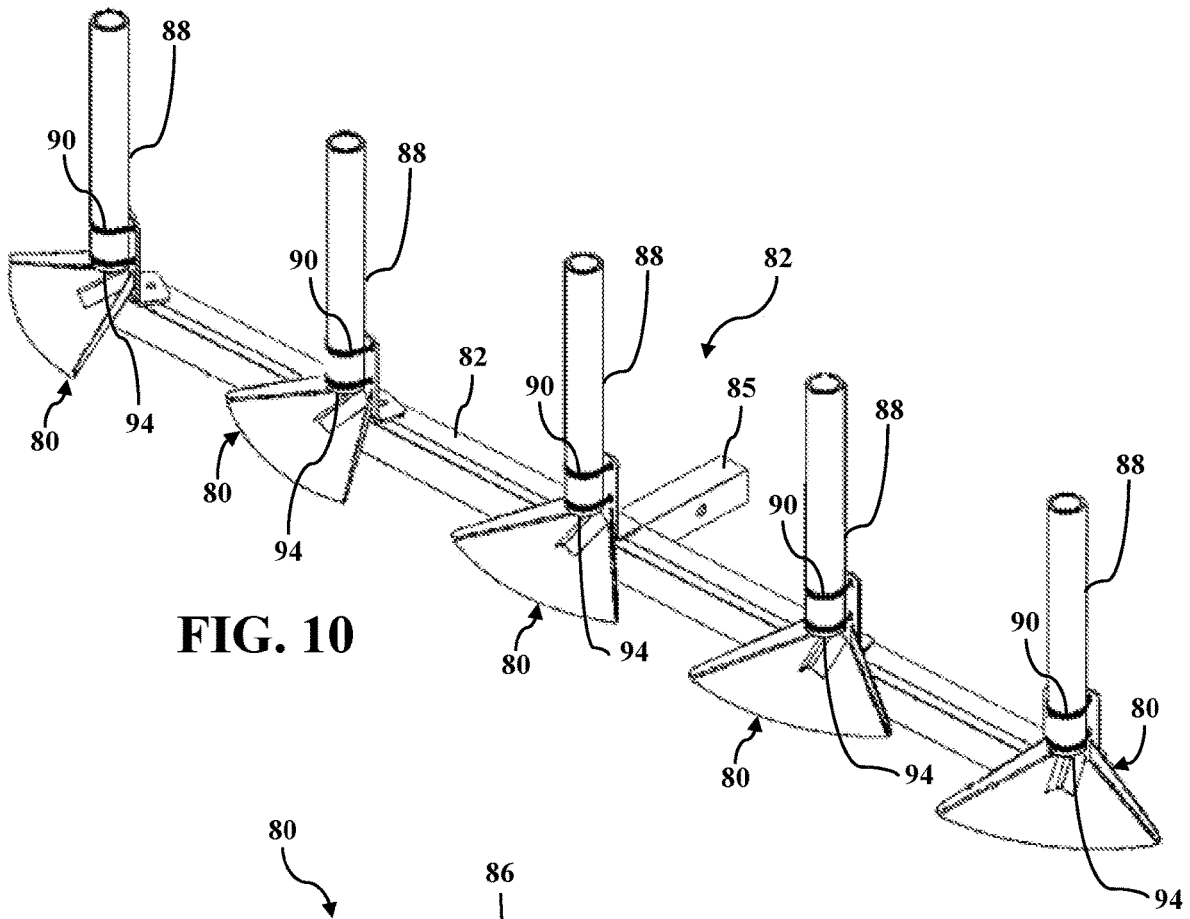
FIG. 10 is a perspective view of a dispenser bar of the spreader system of the present invention.
Figure 11:
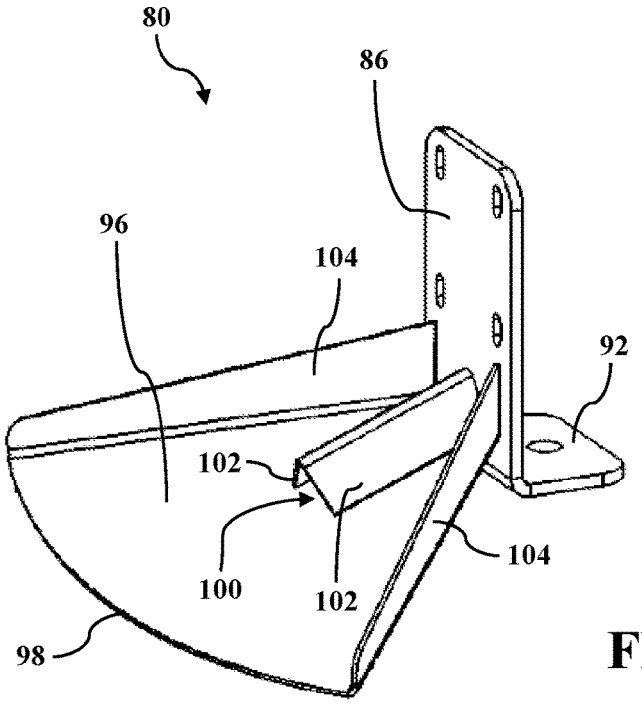
FIG. 11 is a perspective view of at least one dispensing foot of the present invention.

Referring to FIGS. 10 and 11, at least one foot 80, or dispensing foot 80, is connected to the dispenser 36 via tubing, such as, for example, tubes or hoses. The tubing allows the material 22 to be moved between the dispenser 36 and the at least one foot 80. The at least one foot 80 may be a plurality of feet 80 spaced from one another and attached to a frame 82 for attachment to a hitch of a vehicle, or may be a single foot 80. The frame 82 includes a dispenser bar 84 which may be mounted directly to the housing 24 or to, for example, a reese-style hitch 85. The frame 82 is illustrated with five dispensing feet 80, but the spreader system 20 could have more or less. In some embodiments, the plurality of feet 80 are spaced at various locations about the vehicle.

The at least one foot 80 comprises an upright portion 86 for connection to the tubing, and, in particular, to feed tubes 88. The upright portion 86 may be a bracket that mounts to the tubing via a first fastener 90 and mounts to the dispenser bar 84 via a second fastener 92. The feed tubes 88 may be considered a part of or integral with the tubing and connect by a hose or other tube to the dispenser tubes 42. A terminal end 94 of the tubing may be disposed vertically above the at least one foot 80, with the at least one foot 80 extending downwardly at an oblique angle to dispense salt laterally in a fanlike direction. The feet 80 as illustrated are generally a quadrant of a circle, but could have other shapes. It should be appreciated that the housing 24 could also have dispensers 36 to allow vertical dispensing, including the ability to remove the feet 80 for vertical dispensing. In an embodiment not shown, the feet 80 may be vertically mounted to allow the salt, sand, or other ice melt material 22 to flow directly down, or at a degree angle toward the surface. In some embodiments, the feet 80 are at least partly enclosed to direct flow of material 22.

A tray portion 96 extends outwardly at an oblique angle relative to the upright portion 86 to a peripheral edge 98 for allowing the salt, sand, or ice melting compound to deflect laterally from a terminal end 94 of the tubing. A finger 100 is between the tubing and the tray portion 96 adjacent the terminal end 94 of the tubing for deflecting the material 22 laterally. The finger 100 extends at an oblique angle from the upright portion 86 toward the peripheral edge 98. The finger 100 includes a plurality of opposing surfaces 102 connected to one another and extending toward the tray portion 96. The plurality of opposing surfaces 102 may form a V shape of the finger 100 to facilitate even dispensing of material 22. The tray portion 96 includes barriers 104 to guide the material 22 during dispensing. The feed tube 88 or the dispensing tubes 42 may each include an automatic or manual shutoff valve to control material 22 into and out of the tubing. A pre-wetting nozzle may also be mounted to the dispenser bar 84 or to each or some of the feet 80.

The spreader system 20 may be, as illustrated, configured as a bed mounted spreader system 20 for either pickup trucks or larger vehicles, but it will be understood that it could also be used as a tailgate mounted spreader or a UTV mounted spreader system 20, for example. Another variation of the present invention is the ability to distribute brine by using a 12 volt pump or pumps and using the hopper to dispense liquids for anti-icing and de-icing. It should be appreciated that the term "vehicle" refers to any type of vehicle, including but not limited to a tractor, a UTV, ATV, truck, car, or small tractor or wheeled attachment device.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims. These antecedent recitations should be interpreted to cover any combination in which the inventive novelty exercises its utility. The use of the word "said" in the spreader system claims refers to an antecedent that is a positive recitation meant to be included in the coverage of the claims whereas the word "the" precedes a word not meant to be included in the coverage of the claims.

What is claimed is:

1. A spreader system for spreading material on a surface, said spreader system comprising:

a housing having a closed bottom and an open top to allow said material to be loaded into said housing and to store said material;

a pair of interior walls spaced from one another and extending between a first end of the housing and a second end of said housing;

a dispenser selectively coupled to said housing via an interlocking connection between said housing and said dispenser allowing said dispenser to be removed from said housing to define a disassembled position and to be attached to said housing to define an assembled position; and wherein said interlocking connection is formed by a sliding connection between said housing and said dispenser adjacent said first end;

an auger extending between said dispenser and said housing for moving said material between said housing and said dispenser;

a motor disposed in said dispenser for driving said auger;

a manifold of said dispenser to provide a plurality of outlets for said material; and at least one blower disposed on said dispenser to apply pressurized air to said material, wherein said manifold is in fluid communication with said at least one blower to allow pressurized dispensing of said material.

2. The spreader system as set forth in claim 1, wherein said sliding connection includes at least one locking track and defines at least one locking groove, wherein said at least one locking track and said at least one locking groove define said sliding connection.

3. The spreader system as set forth in claim 2, wherein said at least one locking track extends outwardly from said dispenser and said at least one locking groove is disposed on said housing.

4. The spreader system as set forth in claim 1 further including a controller for controlling said motor and said at least one blower;

said controller including a global positioning spreader system, whereby said motor and said at least one blower are controlled based on said GPS.

5. The spreader system as set forth in claim 1 further including at least one foot connected to said dispenser via tubing, said tubing allowing said material to be moved between said dispenser and said at least one foot.

6. The spreader system as set forth in claim 5, wherein said at least one foot includes a finger disposed adjacent a terminal end of said tubing for deflecting said material laterally.

7. The spreader system as set forth in claim 1 further including at least one sideboard extending upwardly at an oblique angle from said top of said housing to guide said material into said housing as said material is loaded into said housing.

8. The spreader system as set forth in claim 1, wherein said material is either salt, sand, or an ice-melting compound, and wherein said surface is a road surface or parking lot surface.

* * * * *